US010731794B2

(12) United States Patent
Cajiga et al.

(10) Patent No.: US 10,731,794 B2
(45) Date of Patent: Aug. 4, 2020

(54) MULTI-STAGE COMPRESSION AND STORAGE SYSTEM FOR USE WITH MUNICIPAL GASEOUS SUPPLY

(71) Applicant: Capat LLC, Miami, FL (US)

(72) Inventors: Jose A. Cajiga, Miami, FL (US); Arturo Cajiga Villar, Miami, FL (US); Vincente Cajiga Villar, Miami, FL (US)

(73) Assignee: CAPAT LLC, Miami, FL (US)

( * ) Notice: Subject to any disclaimer, the term of this patent is extended or adjusted under 35 U.S.C. 154(b) by 95 days.

(21) Appl. No.: 15/665,578

(22) Filed: Aug. 1, 2017

(65) Prior Publication Data

US 2017/0328520 A1 Nov. 16, 2017

Related U.S. Application Data

(60) Division of application No. 14/519,199, filed on Oct. 21, 2014, now Pat. No. 9,759,383, which is a (Continued)

(51) Int. Cl.
*F17C 5/06* (2006.01)
*F17C 13/08* (2006.01)
(Continued)

(52) U.S. Cl.
CPC ..... *F17C 5/06* (2013.01); *F17C 1/14* (2013.01); *F17C 5/007* (2013.01); *F17C 7/00* (2013.01); *F17C 13/026* (2013.01); *F17C 13/08* (2013.01); *F17C 2201/0109* (2013.01); *F17C 2201/054* (2013.01); *F17C 2203/0329* (2013.01); *F17C 2203/066* (2013.01);
(Continued)

(58) Field of Classification Search
CPC ..... F17C 2201/0109; F17C 2201/0114; F17C 2203/0621; F17C 2203/0629; F17C 2203/0631; F17C 2203/0639; F17C 2203/0673; F17C 2221/033; F17C 2270/0139
See application file for complete search history.

(56) References Cited

U.S. PATENT DOCUMENTS 2,652,943 A * 9/1953 Williams ..... B21D 51/24 138/142
2,928,254 A * 3/1960 Rae ..... F17C 3/10 62/394

(Continued)

*Primary Examiner* — Matthew W Jellett
(74) *Attorney, Agent, or Firm* — Grogan, Tuccillo & Vanderleeden, LLP

(57) ABSTRACT

A multi-stage gas compression, storage and distribution system utilizing a hydrocarbon gas from a municipal gaseous supply line in a manner that does not affect an operational integrity of said municipal gaseous supply line includes an inlet line fluidly in fluid communication with a supply of hydrocarbon gas at a first pressure, a first compression unit configured to compress the hydrocarbon gas from the inlet line to a second pressure, a first storage vessel configured to receive the hydrocarbon gas from the first compression unit for storage at the second pressure, a second compression unit configured to compress the hydrocarbon gas from the first storage vessel to a third pressure, and a second storage vessel configured to receive the hydrocarbon gas from the second compression unit for storage at the third pressure.

12 Claims, 6 Drawing Sheets

Related U.S. Application Data continuation-in-part of application No. 13/135,494, filed on Jul. 8, 2011, now Pat. No. 9,234,627.

(51) Int. Cl.

| | |
|---|---|
| ***F17C 1/14*** | (2006.01) |
| ***F17C 5/00*** | (2006.01) |
| ***F17C 7/00*** | (2006.01) |
| ***F17C 13/02*** | (2006.01) |

(52) U.S. Cl.

CPC ..... *F17C 2203/0617* (2013.01); *F17C 2203/0621* (2013.01); *F17C 2203/0639* (2013.01); *F17C 2205/0142* (2013.01); *F17C 2205/0149* (2013.01); *F17C 2205/0196* (2013.01); *F17C 2205/0326* (2013.01); *F17C 2205/0335* (2013.01); *F17C 2221/033* (2013.01); *F17C 2223/0123* (2013.01); *F17C 2223/036* (2013.01); *F17C 2225/0123* (2013.01); *F17C 2225/033* (2013.01); *F17C 2225/035* (2013.01); *F17C 2225/036* (2013.01); *F17C 2227/0157* (2013.01); *F17C 2227/0304* (2013.01); *F17C 2227/0341* (2013.01); *F17C 2227/0381* (2013.01); *F17C 2227/0386* (2013.01); *F17C 2227/0388* (2013.01); *F17C 2227/041* (2013.01); *F17C 2250/032* (2013.01); *F17C 2250/0439* (2013.01); *F17C 2250/0491* (2013.01); *F17C 2250/0631* (2013.01); *F17C 2250/072* (2013.01); *F17C 2260/023* (2013.01); *F17C 2260/025* (2013.01); *F17C 2265/04* (2013.01); *F17C 2265/065* (2013.01); *F17C 2270/0139* (2013.01)

(56) References Cited

U.S. PATENT DOCUMENTS

| | | | | | |
|---|---|---|---|---|---|
| 4,621,633 | A * | 11/1986 | Bowles | A61M 16/1075 | 128/203.17 |
| 4,674,674 | A * | 6/1987 | Patterson | B60P 3/22 | 220/592.2 |
| 4,875,361 | A * | 10/1989 | Sharp | B65D 90/24 | 73/49.2 |
| 5,147,063 | A * | 9/1992 | Pulley | B65D 25/14 | 220/62.11 |
| 5,564,588 | A * | 10/1996 | Reese | B60S 5/02 | 220/565 |
| 6,516,142 | B2 * | 2/2003 | Grant | F24H 1/102 | 392/451 |
| 7,024,868 | B2 * | 4/2006 | Pye | F17C 1/12 | 220/560.04 |
| 7,112,239 | B2 * | 9/2006 | Kimbara | C01B 3/0005 | 96/108 |
| 7,147,124 | B2 * | 12/2006 | Minta | F17C 1/002 | 220/560.07 |
| 8,146,761 | B2 * | 4/2012 | Fawley | B65D 88/128 | 220/1.5 |
| 9,683,702 | B2 * | 6/2017 | Chang | F17C 5/06 | |
| 2009/0142636 | A1 * | 6/2009 | Handa | F17C 1/06 | 429/413 |
| 2010/0146992 | A1 * | 6/2010 | Miller | F17C 3/04 | 62/47.1 |
| 2015/0267866 | A1 * | 9/2015 | Varrassi | F17C 1/06 | 220/560.11 |
| 2015/0316207 | A1 * | 11/2015 | Laney | B05D 1/02 | 220/581 |

* cited by examiner

MULTI-STAGE COMPRESSION AND STORAGE SYSTEM FOR USE WITH MUNICIPAL GASEOUS SUPPLY

CROSS-REFERENCE TO RELATED APPLICATIONS

This application is a divisional application of U.S. Ser. No. 14/519,199, filed Oct. 21, 2014, which is a continuation-in-part of U.S. application Ser. No. 13/135,494, filed on Jul. 8, 2011 (now U.S. Pat. No. 9,234,627 dated Jan. 12, 2016), entitled "System, Apparatus and Method for the Cold-Weather Storage of Gaseous Fuel," the disclosure of which is hereby incorporated by reference herein in its entirety.

FIELD OF THE INVENTION

The present invention relates, generally, to fuel storage and distribution and, more particularly, to multi-stage gas compression, storage and distribution system utilizing a hydrocarbon gas from a municipal gaseous supply line in a manner that does not affect an operational integrity of the municipal gaseous supply line.

BACKGROUND OF THE INVENTION

As gasoline prices have soared and concerns over harmful emissions have mounted in recent years, vehicles that run on alternative fuel sources are becoming increasingly important. For example, the use of compressed natural gas ("CNG") as an alternative fuel for motor vehicles is becoming increasingly popular throughout the world because it is relatively inexpensive, burns cleanly, is relatively abundant and is adaptable to existing technologies.

Natural-gas vehicles use the same basic principles as gasoline-powered vehicles. In other words, the fuel (natural gas) is mixed with air in the cylinder of, e.g., a four-stroke engine, and then ignited by a spark plug to move a piston up and down. Although there are some differences between natural gas and gasoline in terms of flammability and ignition temperatures, natural-gas vehicles themselves operate on the same fundamental concepts as gasoline-powered vehicles. Accordingly, existing gasoline-powered vehicles may be converted to run on CNG, thereby easing the transition between gasoline and CNG in markets where gasoline-powered vehicles are dominant. In addition, an increasing number of vehicles worldwide are being originally manufactured to run on CNG.

Advantageously, CNG-fueled vehicles have lower maintenance costs when compared with other fuel-powered vehicles. In addition, CNG emits significantly fewer pollutants such as carbon dioxide, hydrocarbons, carbon monoxide, nitrogen oxides, sulfur oxides and particulate matter compared to petrol.

Despite the advantages of compressed natural gas as a motive fuel, the use of natural gas vehicles faces several logistical concerns, including fuel storage and infrastructure available for delivery and distribution at fueling stations. Natural gas suitable for vehicle use is customarily stored in small capacity tank, at 3,600 psi at 70° F., and is distributed from storage tanks to an on-vehicle receiving tank by "cascade filling." Cascade filling is accomplished by starting out with the storage tank at a higher pressure than the receiving tank and then allowing this pressure to force the gas (or liquid) into the receiving tank. In so doing, natural gas is transferred, and the pressure in the storage tank drops to the point where the pressures of the two tanks become equal and nothing more is transferred.

The storage and distribution of CNG is severely affected, however, at low temperatures, and particularly when the temperature drops below 40° F. At low temperatures, the pressure in the storage tank drops, thereby resulting in less of a difference in pressure between the receiving tank and the storage tank, ultimately resulting in inefficiencies in gaseous fuel transfer (i.e., less gaseous fuel being transferred to the receiving tank on board the compatible vehicle, and longer filling times).

Moreover, the storage of CNG in large capacity tanks at high pressures is also problematic. In particular, storing CNG in tanks at 3,000-3,600 psi requires that the tank's walls be cast from thick steel or other suitable metal in order to withstand the enormous stresses caused by the compressed gas. As will be readily appreciated, large capacity CNG storage tanks would therefore be undesirably heavy and inefficient and expensive to manufacture and transport. As a result, transportation and storage of CNG is customarily effectuated by using numerous smaller, tube-shaped cylinders, which themselves are extremely heavy.

With the forgoing problems and concerns in mind, it is the general object of the present invention to provide a system and method for the cold-weather storage and distribution of gaseous fuels, which utilizes large capacity tanks that are insulative and have a reduced weight.

SUMMARY OF THE INVENTION

With the forgoing concerns and needs in mind, it is a general object of the present invention to provide a system and apparatus for the storage of gaseous fuels.

It is another object of the present invention to provide a system and apparatus for the storage of compressed natural gas.

It is another object of the present invention to provide a system and apparatus for the storage of gaseous fuels that allows for significant weight savings to be realized as compared to existing storage tanks.

It is another object of the present invention to provide a system and apparatus for the storage of gaseous fuels that has a decreased manufacturing time and cost as compared to existing systems and apparatuses.

It is another object of the present invention to provide a system and apparatus for the storage of gaseous fuels that utilizes a double-walled tank.

It is another object of the present invention to provide a system and apparatus for the storage of gaseous fuels that utilizes a double-walled tank that is capable of withstanding high pressures than existing single-walled tanks having similar wall thickness.

It is another object of the present invention to provide a system and apparatus for the storage of gaseous fuels that utilizes a double-walled tank having an insulative layer.

It is another object of the present invention to provide a system and apparatus for the storage of gaseous fuels that is easy to manufacture.

According to an embodiment of the present invention, a gas compression, storage and distribution system is provided. The system includes an inlet line fluidly in fluid communication with a supply of hydrocarbon gas at a first pressure, a first compression unit configured to compress the hydrocarbon gas from the inlet line to a second pressure, a first storage vessel configured to receive the hydrocarbon gas from the first compression unit for storage at the second pressure, a second compression unit configured to compress the hydrocarbon gas from the first storage vessel to a third pressure, and a second storage vessel configured to receive the hydrocarbon gas from the second compression unit for storage at the third pressure.

In an embodiment of the present invention, a method of supplying compressed hydrocarbon gas is provided. The method includes compressing a supply of hydrocarbon gas from a first pressure to a second pressure, the second pressure being greater than the first pressure, storing the hydrocarbon gas in a first storage tank at the second pressure, compressing the hydrocarbon gas from the first storage tank to a third pressure, the third pressure being greater than the second pressure, and storing the hydrocarbon gas in a second storage tank at the third pressure.

In another embodiment of the present invention, a gas compression system is provided. The system includes a first compression apparatus for compressing a supply of gas from a first pressure to a second pressure, a first storage means for storing said gas at said second pressure, a second compression apparatus for compressing said gas from said second pressure to a third pressure, and a second storage means for storing said gas at said third pressure.

These and other objectives of the present invention, and their preferred embodiments, shall become clear by consideration of the specification, claims and drawings taken as a whole.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The present invention will be better understood from reading the following description of non-limiting embodiments, with reference to the attached drawings, wherein below.

DETAILED DESCRIPTION OF THE PREFERRED EMBODIMENT

Figure 1:
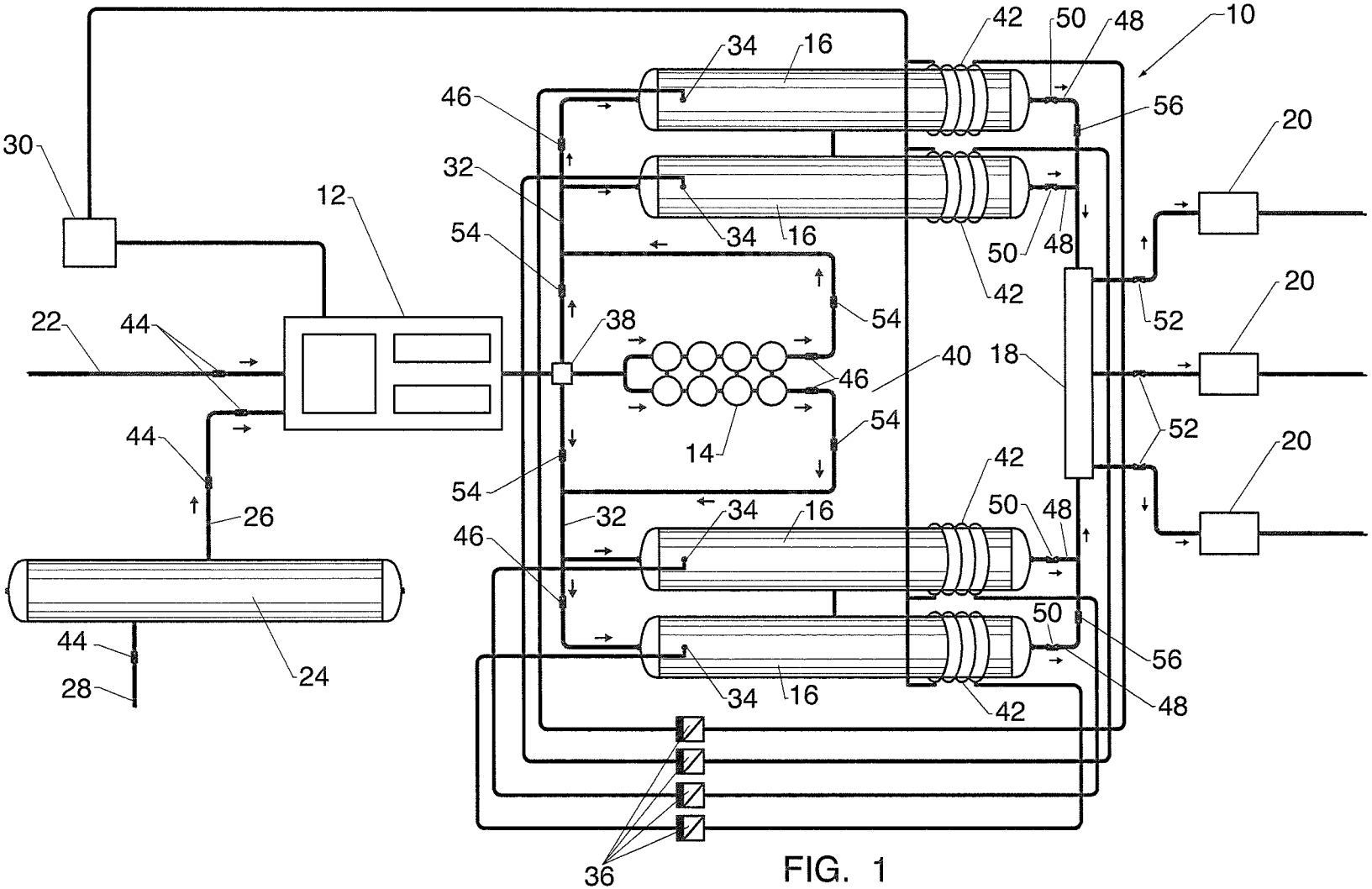
FIG. 1 is a schematic view of a system for the cold-weather storage of gaseous fuels in accordance with one embodiment of the present invention.

An embodiment of the system of the present invention is indicated in general at 10 in FIG. 1. As shown therein, the system includes a slow fill compressor 12, a heat exchange apparatus 14, a plurality of gaseous fuel storage tanks 16, a manifold 18 and a plurality of fast fill dispensers 20.

As described in greater detail below, gaseous fuel, e.g., natural gas, is transferred from a low-pressure source to the slow fill compressor 12. As used herein, "low pressure" is intended to mean the pressure at which the particular gas is originally introduced to the system 10. In the preferred embodiment, the low-pressure source is a low pressure gas line 22 extending from a gas main, wherein the low pressure is the line pressure of the gas main. Alternatively, however, the low-pressure source may be a low-pressure gas tank 24 that is fluidly connected to the slow fill compressor 12 by a pipeline 26. In this embodiment, the natural gas may be delivered by a tanker truck, unloaded from the truck via a loading pipeline 28, and stored in the low-pressure gas tank 24 for use on demand. In any event, the low pressure gas line 22 and/or the low pressure gas tank 24 provide an on-demand supply of gaseous fuel for compression, storage and distribution by the system 10, as described in detail hereinafter.

Returning to FIG. 1, the slow fill compressor 12 includes an inlet and an outlet and may be of the type known in the art, but in any event has a relatively low flow rate. The slow fill compressor 12 is in electrical communication with a power supply 30 for powering the compressor 12. The power supply 30 may be an electrical outlet hooked up to the power grid. In alternative embodiments, the power supply 30 may be a generator, one or more batteries, or an alternative power generation device such as a solar panel or the like, without departing from the broader aspects of the present invention. In operation, the slow fill 12 compressor intakes and compresses the low-pressure gaseous fuel from the low-pressure source 22 or 24. The compressed gas is then routed through a direct fill line 32 to the storage tanks 16, from which it can then be dispensed to compatible vehicles through one or more fast fill dispensers 20.

As alluded to above, gaseous fuel storage and distribution and, in particular CNG storage and distribution are greatly affected when temperatures drop below 40° F. It is therefore crucial for efficient storage and distribution that the CNG in the storage tanks is maintained at roughly 70° F. at 3,600 psi, as is standard in the industry. Importantly, the system 10 further includes a means of maintaining the temperature of the gaseous fuel in the storage tanks at a desired level, even when ambient air temperature drops, as discussed below.

In cold weather, especially below 40° F., the temperature of the gaseous fuel in the storage tanks begins to drop, as does the pressure within the storage tanks. As gaseous fuel stored in the tanks 16 is distributed to compatible vehicles, the slow fill compressor 12 is actuated to intake and compress source gas to replenish the gaseous fuel and pressure in the tanks 16. As the low-pressure source gas is compressed by the slow fill compressor 12, its temperature, as well as pressure, rises. This heated, compressed gas is then routed along the direct fill pipeline 32 to the storage tanks 16 for storage. The warmer compressed gas enters the tanks 16 so as to allow the incoming, warmer compressed gas to mix with the gaseous fuel already present in the tanks 16 so as to raise its temperature to a desired and optimum point, namely, approximately 70° F.

In this manner, compression of low-pressure source gas generates heat, which is then transferred to the gaseous fuel inside the storage tanks 16 to maintain the temperature thereof. As will be readily appreciated, fuel distribution to compatible vehicles triggers an almost continuous, slow pumping and compression of source gas, thereby providing the storage tanks 16 with an almost continuous supply of heat. As a result, cost savings can be realized because stand-alone heaters do not need to be utilized to maintain the temperature of the gaseous fuel within the tanks.

As further shown in FIG. 1, each of the storage tanks 16 includes a temperature sensor 34 connected to a thermostat 36, each of which are set to maintain a desirable temperature of gaseous fuel inside each tank 16. When the desired or setpoint temperature is reached within the tanks 16, the thermostat 36 sends a signal to a solenoid valve 38 which changes the direction of the compressed gas exiting the slow fill compressor 12. In particular, a solenoid valve 38 adjacent the exit of the slow fill compressor 12 is actuated such that the compressed gas exiting the slow fill compressor 12 is not routed directly into the storage tanks 16 via the direct fill line, but is instead directed along a heat exchange loop 40 having a heat exchange apparatus 14. The heat exchange apparatus 14 effectively cools the compressed gas, i.e., heat from the gas is transferred to the heat exchange apparatus 14, before the gas is directed back to the storage tanks 16. Once cooling is effectuated, the compressed gas exits the heat exchange loop 40 and is fed into to a downstream portion of the direct fill line 32 and, ultimately, into the storage tanks 16.

In the event that the tanks 16 are full, for instance when no dispensing is occurring, no compression is taking place and thus no heat from the compression of source gas is available to maintain the temperature of the gaseous fuel inside the storage tanks 16. Accordingly, in order to maintain the temperature of the gaseous fuel in cold weather during times of little or no replenishing of the tanks (i.e., when fuel dispensing is low), the storage tanks 16 are additionally provided with an auxiliary electric heater 42 located in the main body of each of the tanks, discussed in more detail below. In the preferred embodiment, the power supply 30 that powers the slow fill compressor 12 also powers each electric heater 42, although a separate power supply may also be used without departing from the broader aspects of the present invention.

Importantly, as discussed above, the temperature sensor 34 positioned within each storage tank 16 monitors a temperature of the gaseous fuel within each tank 16. As shown in FIG. 1, each temperature sensor 34 is connected to a thermostat 36 that is set to maintain a desired temperature within each tank 16. In the preferred embodiment, the desired temperature is approximately 70° F., although the thermostat 36 can be configured to maintain any desired setpoint temperature. When the heat generated from compression of the low pressure source gas is not is not available to maintain the temperature of the gaseous fuel within the tanks 16, or when compression generated heat cannot keep up with temperature demand, the temperature sensor 34 will detect declining temperatures or a temperature below the setpoint temperature of the thermostat 36. In response, the auxiliary heater 42 will be activated by the thermostat 36 to provide auxiliary heat to each fuel tank 16 to maintain or raise the temperature inside each tank 16. Once the temperature of the gaseous fuel within the storage tanks 16 again reaches the setpoint temperature of the thermostat 36, the auxiliary electric heater 42 is automatically switched off.

Preferably, the electric heater 42 is envisioned as a "blanket" which surrounds at least a portion of the tanks 16, although other configurations and positioning of the electric heater 42 are also contemplated in the present invention.

As further shown in FIG. 1, valves 44 control the flow of low pressure gas from the loading truck into the low pressure tank 24, from the low pressure tank 24 into the slow fill compressor 12, and from the low pressure gas line 22 into the slow fill compressor 12. Other valves 46 control the flow of pressurized gas from the heat exchange apparatus 14 into the storage tanks 16. The output pipeline 48 of each storage tank 16 is also configured with a valve 50 to control the flow of compressed gaseous fuel from the tanks 16 to the manifold 18. Finally, valves 52 control the flow of gaseous fuel from the manifold 18 to each fuel dispenser 20.

Check valves 54 are positioned downstream from the solenoid valve along the direct fill line 32 and downstream the heat exchange apparatus 14 along the heat exchange loop 40. The check valves 54 desirably control the direction of flow through the heat exchange loop 40 and the direct fill line 32 toward the storage tanks 16, and prevent undesirable flow reversals that might otherwise occur due to unexpected pressure changes, leaks, equipment failures, or the like. Check valves 56 are also positioned along the output pipelines to control the direction of flow therethrough and to prevent similar flow reversals.

Importantly, the system 10 of the present invention is, broadly speaking, applicable to CNG storage tank assemblies of any size, both small and large capacity. The large capacity tank concept complements this system in the preferred embodiment, but it is not required.

In connection with the above, the configuration of the gaseous fuel storage tanks 16 is another important aspect of the present invention. In the preferred embodiment, each tank 16 is a large capacity tank, capable of storing a large quantity of gaseous fuel, in contrast to known small-volume tanks. Where the gaseous fuel is compressed natural gas, stored at approximately 70° F. and 3,600 psi, each tank 16 has a storage capacity large enough fill 500-700 compatible vehicles with CNG. Moreover, each storage tank is specially designed to withstand the pressures of the gaseous fuel inside the tank 16 and to insulate the gaseous fuel inside the tank from outside, ambient air, while having a lower weight profile than has heretofore been known.

Figure 2:
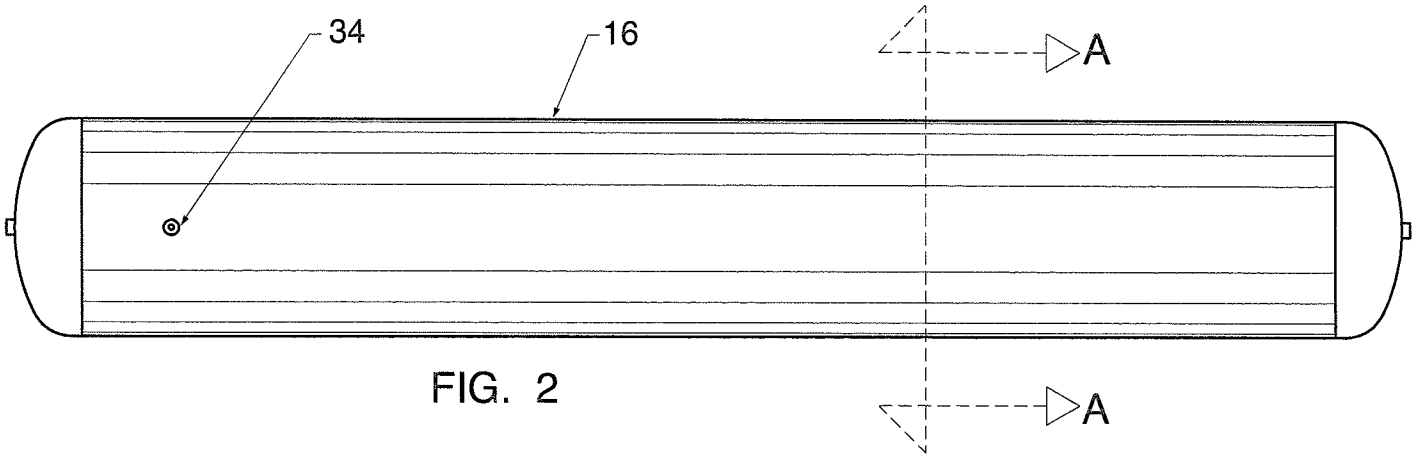
FIG. 2 is a side elevational view of a gaseous fuel storage tank for use with the system of FIG. 1.
Figure 3:
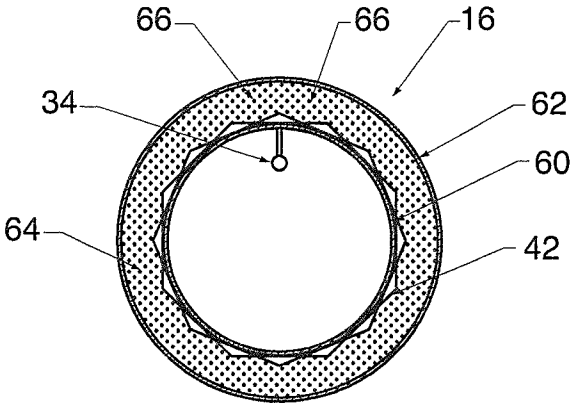
FIG. 3 is a cross-sectional view of the gaseous fuel storage tank for use in connection with the system of FIG. 1, taken along line A-A of FIG. 2.

FIGS. 2 and 3 show the configuration of a large-capacity storage tank 16. As shown therein, each tank 16 is generally cylindrical in cross-section and includes an inner tank wall 60 and an outer tank wall 62 defining an annular space 64 therebetween, the inner and outer walls 60,62 being generally concentric. Within the annular space 64, the auxiliary electric heater 42 is preferably disposed. The auxiliary electric heater 42 comprises a fiber carbon or metal electric mesh, through which electrical current is provided to produce heat. The mesh auxiliary heater 42 is preferably wrapped around the outer peripheral surface of the inner wall 60 of the tank 16 and preferably extends the length of the inner wall 60.

As further shown therein, a polymer based resin 66 fills the remainder of the annular space 64. Importantly, this resin 66 functions as an insulation layer to insulate the interior of the tank from the outside, ambient air (and potential low temperature thereof), as well as functioning as a mechanical reinforcement layer that effectively bonds the inner wall 60 to the outer wall 62, and as a shock absorber for absorbing stress on the walls of the inner wall 60. In this manner, the inner wall 60 and outer wall 62 are essentially joined together as a single unit. As will be readily appreciated, this increases the ability of the tank 16 to withstand the high pressures of gaseous fuel stored therein, as discussed below. In addition, the use of two walls bonded together with a polymer resin 66 decreases the weight of the tank 16 as compared to a single-walled tank of equal volume.

In the preferred embodiment, each wall is manufactured from steel, although other metals or materials known in the art may also be used without departing from the broader aspects of the present invention. Preferably, the walls of each wall 60,62 are approximately 1" thick in embodiments where steel is utilized. In contrast to the present invention, known single-wall storage tanks not having the structure of the tanks 16 shown in FIGS. 2 and 3 would have to be manufactured with walls that are 3" thick to safely withstand the pressures, approximately 3,600 psi, inside the tank. As will be readily appreciated, providing a tank with inch-thick walls is advantageous because the tanks can be manufactured by rolling, whereas a tank with 3" thick walls cannot be rolled using known methods and devices, but instead must be cast and, of course, would exhibit a much higher weight profile.

Through testing, it has been shown that the greatest stresses in cylindrical storage tanks oriented in the horizontal direction are concentrated along the top of the tank. Advantageously, as discussed above, the polymer based resin 66 disposed in the annular space 64 functions as a shock absorber to absorb the stresses upon the inner wall 60 of the tank, such that the outer wall 62 is subject to little stress, thereby allowing the walls 60,62 to be manufactured from steel or other metals of a lesser thickness. As compared to a single-walled storage tank having the same capacity and suitable to withstand gaseous fuel at a pressure of 3,600 psi at 70° F., the tank 16 of the present invention provides for an approximately 50% reduction in weight. In addition, significant weight savings are also realized in comparison to utilizing a large number of smaller storage tanks to store the same volume of gas, as more tanks equate more weight.

Figure 4:
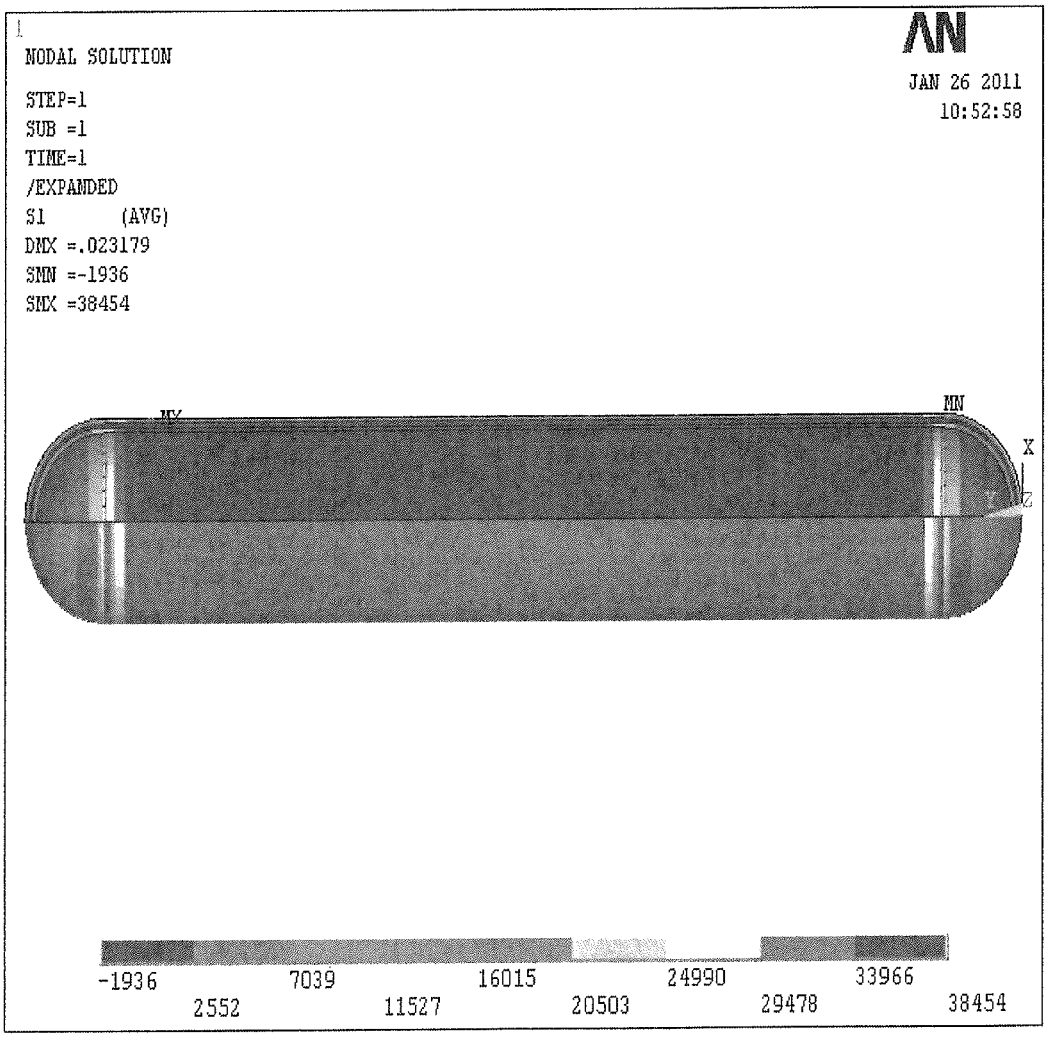
FIG. 4 is a diagram illustrating the stresses in the walls of the storage tank of FIG. 2 at an internal pressure of 3,600 psi.

Referring now to FIG. 4, a finite element analysis evidences the advantages provided by the large capacity, double-walled tank of the present invention. In particular, as shown in FIG. 3, at 3,600 psi, the large capacity of the tank 16 of the present invention, having a 40" diameter inner chamber defined by an inner wall 60 that is 1" thick, a 44" diameter outer chamber defined by an outer wall 62 that is 1" thick, and a 1" thick resin 66 disposed in the annular space 64 between the walls 60,62 results in a maximum von Mises stress of 38,454 psi in the top of the inner wall 60, within material limits (see top half of tank in FIG. 4). In addition, the outer wall (bottom half of tank in FIG. 4) exhibits a stress of 33,966 psi, also within material limits. The weight of the tank having these parameters is approximately 10 tons.

Figure 5:
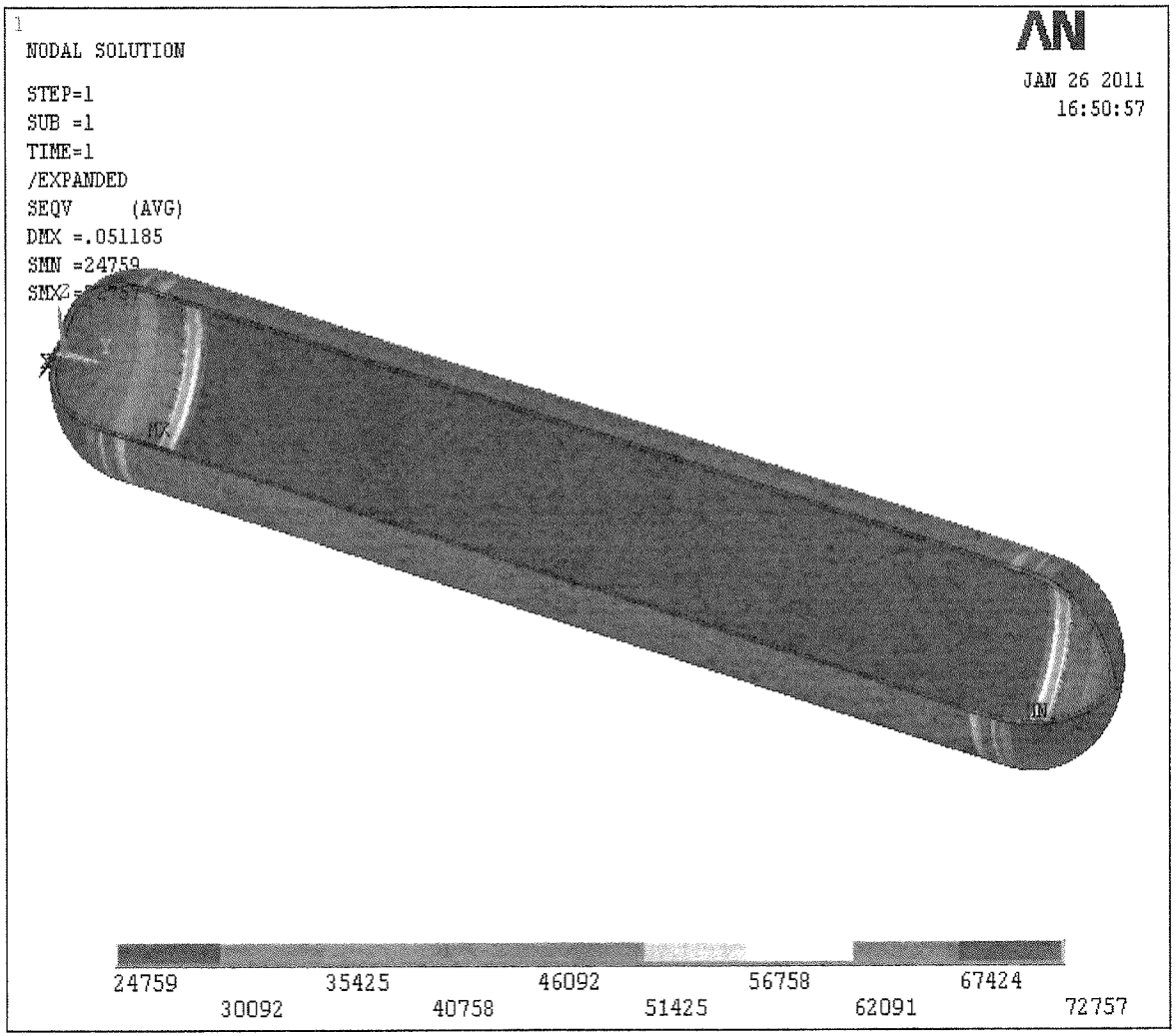
FIG. 5 is a diagram illustrating the stresses in the wall of a single-walled storage tank at an internal pressure of 3,600 psi.

In contrast, finite element analysis of a single walled tank having a 44" diameter and a 1" thick wall has shown that the tank would yield to internal pressures prior to reaching the optimum internal pressure of 3,600 psi. As shown in FIG. 5, the von Mises stress is 72,757 psi in the sidewall, well above material limits. Accordingly, in order to withstand pressurization at 3,600 psi, the walls of a single walled tank having a 44" diameter would need to be 3" thick, as discussed above, which would translate to a gross tank weight of approximately 15 tons. As will be readily appreciated, in these examples, the double-walled tank 16 of the present invention allows for a weight savings of 5 tons over a single-walled tank. In addition to the weight savings, in contrast to the 3" thick single-wall tank, the tank 16 of the present invention can be rolled, rather than cast, thereby decreasing manufacturing time and cost.

It is therefore another important aspect of the present invention that the gaseous fuel storage tank 16 of the system of the present invention is capable of withstanding much higher pressures than known single-walled tanks of similar wall thickness. As a result, significant savings in weight, materials, cost, and ease of manufacture are realized, as discussed above. In view of the above, the present invention therefore provides a much lighter tank with the added ability to more precisely control the temperature of pressurized gaseous fuel stored within the tank. Indeed, by utilizing the compression of source gas to maintain the temperature within the storage tanks, significantly less energy is expended than would be the case if a stand-alone heater were utilized. Importantly, the temperature sensor and thermostat allow the temperature within the tanks to be more precisely controlled. Moreover, when the tanks are full and no compression is needed to fill the tanks, the temperature sensor and thermostat are arranged so as to control the auxiliary electric heater located in the main body of the tank to further maintain an optimum temperature of the CNG stored therein.

As discussed in detail above, the system 10 of the present invention utilizes the heat generated by gaseous compression of the fuel as a way to maintain the proper temperature and pressure regiment within the CNG storage tanks. In addition, the present invention provides a novel construction for large capacity CNG storage tanks that can be manufactured economically and at a much reduced weight profile. It will therefore be readily appreciated that a combination of the system 10 shown in FIG. 1, with the large capacity tanks 16 shown in FIGS. 2 and 3, results in a compressed gaseous fuel dispensing assembly that is more economical and efficient than has heretofore been known in the art.

Figure 6:
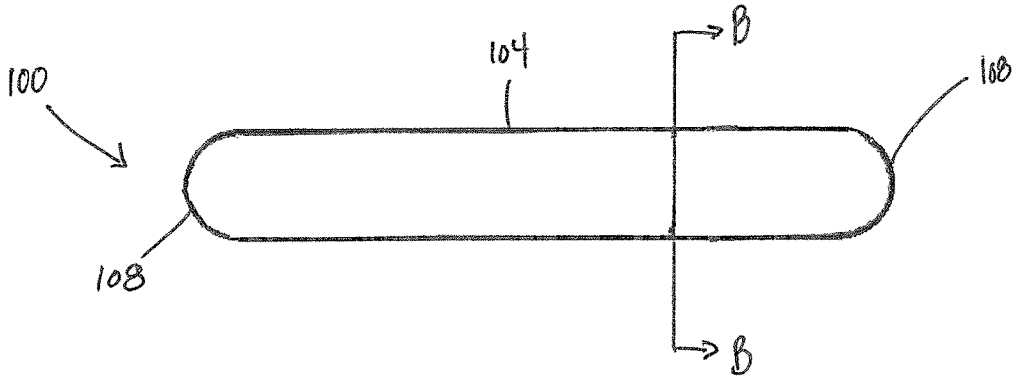
FIG. 6 is a side elevational view of a gaseous fuel storage tank for use with the system of FIG. 1, according to another embodiment of the present invention.
Figure 7:
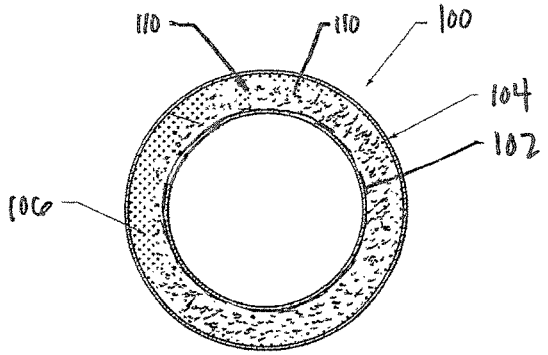
FIG. 7 is a cross-sectional view of the gaseous fuel storage tank of FIG. 6, taken along line B-B.
Figure 8:
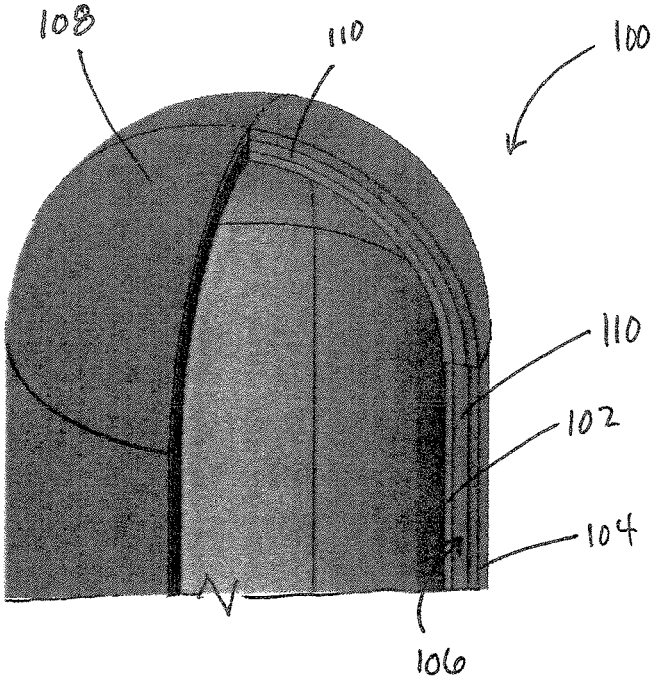
FIG. 8 is an enlarged, perspective, partial cross-sectional view of an end of the gaseous fuel storage tank of FIG. 6.

Referring now to FIGS. 6-8, a large-capacity tank 100 for the storage of gaseous fuel according to another embodiment of the present invention, is shown. As shown therein, tank 100 is generally similar in construction to tank 16 described above. Like tank 16, tank 100 is a double-walled tank that is generally cylindrical in shape. As best shown in FIGS. 7 and 8, the tank includes a cylindrical inner body 102 and a cylindrical outer body 104 defining an annular space 106 therebetween. A pair of double-walled, semi-spherical end caps 108 are welded to the inner and outer tank bodies 102, 104, as best shown in FIG. 8. In the preferred embodiment, the inner body 102, outer body 104 and end caps 108 are manufactured from steel, although other metals or materials known in the art may also be used without departing from the broader aspects of the present invention. More preferably, the inner body 102, outer body 104 and end caps 108 are manufactured from ASTM A537 Class 1 Carbon Steel. As also shown in FIGS. 7 and 8, a resin epoxy 110 fills the annular space 106 between the inner and outer tank bodies 102, 104.

In the preferred embodiment, the tank 100 (defined by the outer body 104 and end caps 108) has an outside diameter of approximately 24 inches and is approximately 244 inches long. The thickness of the outer body 104 is approximately 0.375 inches. The inner body has an inside diameter of approximately 20 inches and is approximately 240 inches long. The thickness of the inner body 102 may range from approximately 0.375 to 0.625 inches, but preferably has a thickness of 0.625 inches.

As best shown in FIG. 8, the inner and outer walls of the end caps 108 are slightly thicker than the inner and outer bodies 102, 104. Preferably, the inner and outer walls of the end caps are approximately 0.25 inches thicker than the inner and outer bodies 102, 104, respectively. As will be readily appreciated, therefore, the inner body 102 and inner walls of the end caps 108 define an 'inner tank,' while the outer body 104 and outer walls of the end caps 108 define a larger, 'outer tank.'

Importantly, the resin 110 within the annular space 106 functions as thermal insulation, keeping the inner tank 102 insulated from outside weather and temperatures. In addition, as discussed above, the resin 110 also functions as a mechanical reinforcement layer that effectively bonds the inner tank to the outer tank, and as a shock absorber for absorbing stress on the walls of the inner tank. In this manner, the inner tank and outer tank are essentially joined together as a monolithic assembly. As will be readily appreciated, this increases the ability of the tank 100 to withstand the high pressures of gaseous fuel stored therein. In addition, the use of two walls bonded together with an epoxy resin decreases the weight of the tank 100 as compared to a single-walled tank of equal volume. Moreover, by utilizing a double-walled tank, the walls thereof may be made thinner as compared to those of a single-walled tank, thereby providing for an ease of construction and welding.

Through testing, it has been demonstrated that at 3,600 psi, and 70° F., the large capacity of the tank 100 of the present invention, having an outer tank having an outside diameter of 24" and having walls that are 0.375" thick, an inner tank having an inside diameter of 20" and having walls that are 0.5" thick, and resin disposed in the annular space between the two tanks, exhibits a maximum von Mises stress of approximately 43,073 psi, within material limits.

Through testing, it has also been demonstrated that at 3,600 psi, and 70° F., the large capacity of the tank 100 of the present invention, having an outer tank having an outside diameter of 24" and having walls that are 0.375" thick, an inner tank having an inside diameter of 20" and having walls that are 0.625" thick, and resin disposed in the annular space between the two tanks, exhibits a maximum von Mises stress of approximately 38,301 psi, also within material limits.

As discussed above, it is therefore another important aspect of the present invention that the gaseous fuel storage tank 100 of the system of the present invention is capable of withstanding much higher pressures than known single-walled tanks of similar wall thickness. As a result, significant savings in weight, materials, cost, and ease of manufacture are realized, as discussed above.

As will be readily appreciated, a new, double-wall natural gas storage tank has been described. Application of such double-wall tank will now be discussed. In the United States and much of the developed world, natural gas is supplied through small diameter municipal pipes to homes and businesses, where it is used for many purposes including ranges and ovens, gas-heated clothes dryers, heating/cooling, and central heating. Heaters in homes and other buildings may include boilers, furnaces, and water heaters. The gas in these supply mains is typically at a low pressure, around 5 psi, which is sufficient and desirable for many such home uses. For applications such as in commercial energy production or personal transport vehicles, however, natural gas must be pressurized well in excess of what is available from standard supply mains, and on the order of 3,600 psi.

In connection with the above, it is known in the industry to utilize large compressors (on the order of 400 plus horsepower) to draw natural gas from the municipal supply main and to compress such gas from the line pressure to the desired 3,600 psi suitable for, for example, energy production or vehicle use. However, because of the small diameter of the supply main piping and the comparatively low pressure within the main, the use of such large compressors is known to deteriorate the integrity of the overall natural gas supply system. In particular, the operation of such large compressors can create a demand so large that the supply of gas in the main cannot keep up, essentially 'drying' the line for surrounding and/or downstream consumers. Consequently, any time that a vehicle or energy plant is consuming large quantities of highly pressurized gas, the surrounding consumers of natural gas in homes and businesses may be left without an adequate supply for some period of time.

Because known prior art systems recognize the integrity of the natural gas supply system is being compromised, companies utilizing such systems ensure that these large compressors are only in operation for a very short amount of time (sufficient to pressurize the gas to 3,600 psi). Accordingly, while utilizing large compressors does achieve the goal of quickly raising natural gas from a line pressure of approximately 5 psi to the approximately 3,600 psi required for vehicle/energy production use, and while the downstream detriment is only apparent for a short amount of time, the system, as a whole, is still adversely effected. In addition, the use of such large horsepower compressors, and the energy demand thereof when in operation, is a detriment to the overall efficiency of the system. Indeed, utilizing large compressors on the order of 400 hp consumes a substantial amount of power, contributing to high operational costs. Moreover, once the gas is compressed, it is stored in tanks. Existing tanks, however, are enormously heavy and costly to manufacture, as discussed above.

Accordingly, there is a need for a system capable of stepping up the pressure of natural gas from a line pressure of approximately 5 psi to the approximately 3,600 psi (or more) necessary for vehicle/energy production use that uses less power, is more flexible, and minimizes any effects on the overall integrity of the natural gas supply system, as compared to existing systems.

Figure 9:
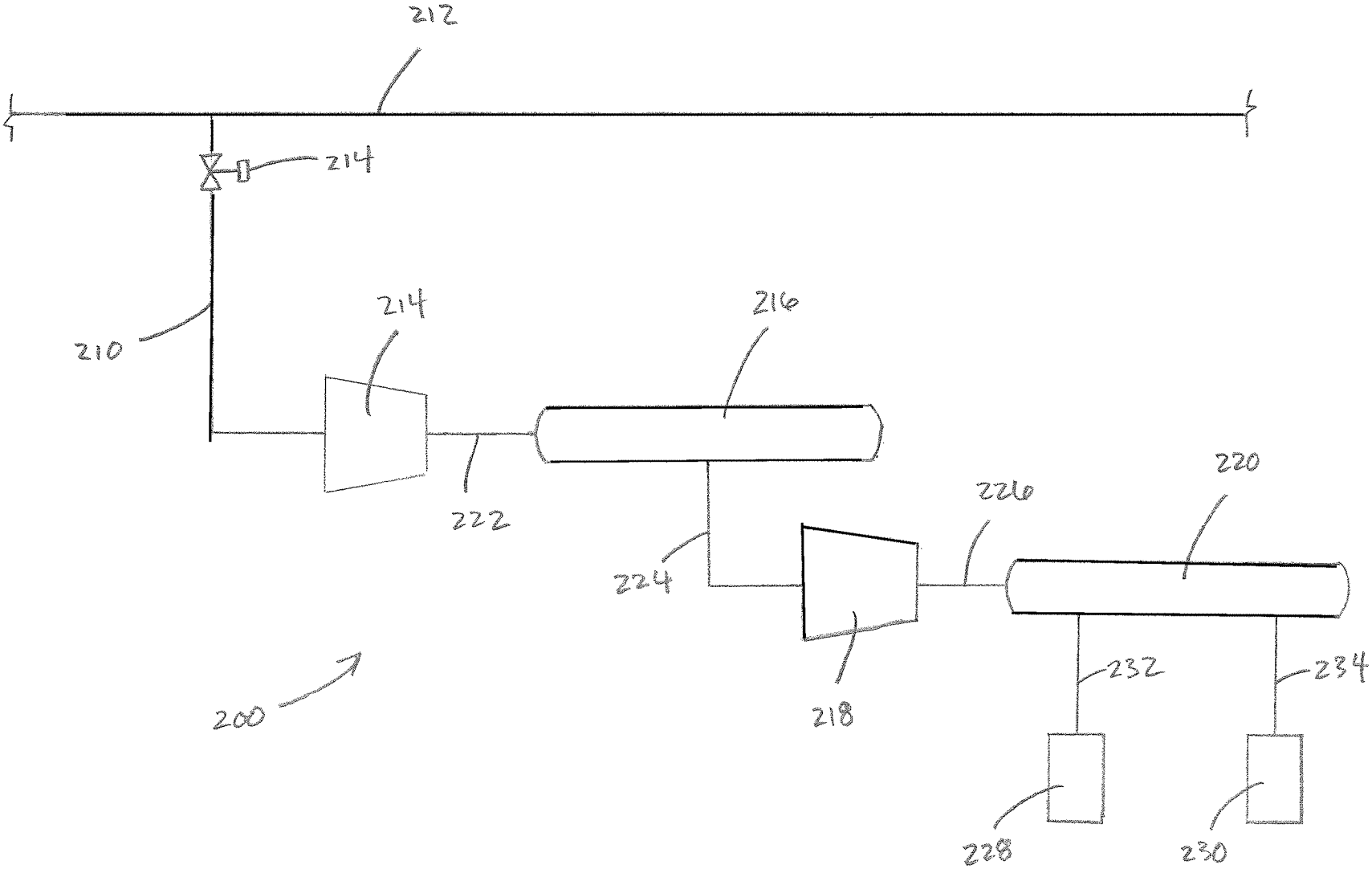
FIG. 9 is a schematic illustration of a gas compression system according to an embodiment of the present invention.

With reference to FIG. 9, a gas compression system 200 for the compression, storage and distribution of natural gas suitable for, for example, vehicle use is shown. The system 200 includes an inlet line 210 for delivering gas to the gas compression system 200. The inlet line 210 attaches to a supply line 212. The supply line 212 may be fluidly coupled to or part of a utility distribution system that distributes natural gas to residential and commercial customers of natural gas, and operates at nominal pressures of from about 0.5 psi to about 200 psi. Alternatively, the supply line 212 may be in communication with a transmission line and may have example operating pressures of from about 200 psi to about 1500 psi.

For purposes of this disclosure, example gases include any and all hydrocarbons that are a gas at standard temperature and pressure, such as but not limited to methane, ethane, propane, butane, and mixtures thereof. In an example, the hydrocarbons can be saturated or unsaturated, and the gas can include trace amounts of non-hydrocarbons, such as nitrogen, hydrogen, oxygen, sulfur.

With further reference to FIG. 9, a shut-off valve 214, which may optionally be automated or manual, is shown at the connection between the inlet line 210 and supply line 212 for selectively allowing or preventing gas from the supply line 212 to enter the inlet line 210. The system 200 further includes a first compressor 214 fluidly coupled to the inlet line 210, a first compressed gas storage tank 216, a second compressor 218, and a second compressed gas storage tank 220. The first storage tank 216 is coupled to the first compressor 214 by line 222. Line 224 fluidly couples an outlet of the first storage tank 216 with an inlet of the second compressor 218. Similarly, the second compressor 218 is coupled to the second storage tank 220 by line 226.

The first compressor 214 is configured to compress the gas from the inlet line 210 from the approximate 5 psi line pressure to a secondary pressure, such as approximately 2000 psi. The gas, once compressed to 2000 psi, is passed through outlet line 22 and supplied to the first storage tank 216 for storage. In the preferred embodiment, the first compressor 214 is a 50 horsepower air compressor that compresses approximately 30 GGEs (gasoline gallon equivalent) of natural gas per hour. Although the first compressor 214 is disclosed as being a 50 horsepower compressor, the first compressor 214 may be slightly larger or smaller without departing from the broader aspects of the present invention.

As discussed above, the system 200 also includes a second compressor 218, which is configured to receive gas from the first storage tank 216, through line 226, and compress the gas from the first storage pressure to a second storage pressure, such as approximately 3,600 psi. The gas, once compressed to 3,600 psi by the second compressor 218, is passed through outlet line 226 and supplied to the second storage tank 200 for storage. In the preferred embodiment, the second compressor 218 is, likewise, a 50 horsepower air compressor, although the compressor 218 may be rated for slightly more or less than 50 horsepower without departing from the broader aspects of the present invention.

In the preferred embodiment, the first storage tank 216 may be any type of tank known in the art rated for storing gas at approximately 2,000 psi. In another embodiment, the first storage tank 216 may be a double-walled tank as described herein and rated for 2,000 psi. In the preferred embodiment, the second storage tank 220 may be a double-walled tank manufactured in accordance with the specifications described herein and shown in FIGS. 2-8.

Gas compressed in the gas compression system 200, and stored in the second storage tank 220, can be accessible to end users of the compressed gas via dispensers 228, 230. Nozzles (not shown) on dispensers 228, 230 provide a flow path for gas compressed in the system 200 to a vehicle (not shown), energy production plant, or other storage vessel for compressed gas purchased by a consumer. Thus, dispensers 228, 230 may be equipped with card readers or other payment methods so that a consumer may purchase an amount of compressed gas at the dispensers 228, 230. Although two dispensers 228, 230 are shown, it is envisioned that the gas compression system 10 can have more of fewer dispensers without departing from the broader aspects of the present invention. Lines 232, 234 provide example flow paths between the gas compression system 200 and dispensers 228, 230.

While the system 200 described above is illustrated with a single storage tank 216 for storing compressed gas at a pressure of approximately 2000 psi, and a single storage tank for storing compressed gas at a pressure of approximately 3,600 psi, a plurality of tanks may be utilized to store the gas at the dual pressures without departing from the broader aspects of the present invention. In the preferred embodiment, there are two, 2000 psi storage tanks and two, 3,600 psi storage tanks. As indicated, the second, 3,600 psi storage tanks may be double-walled tanks manufactured in accordance with the specifications described herein and shown in FIGS. 2-8. Preferably, the system 200 has enough stored gas to meet the CNG demand of consumers for two or more days.

In operation, gas is received by the first compressor 214 through inlet line 210 when valve 214 is opened. The first compressor 214 compresses the gas from the inlet line 210 to approximately 2,000 psi and passes the compressed gas through outlet line 222 for storage in first storage tank 216. Importantly, the first compressor 214 is configured to operate almost continuously (approximately 16 hours per day) to slowly and almost continuously fill the first storage tank 216 with compressed gas at 2,000 psi. Once stored, the compressed gas from the first storage tank 216 may then be supplied to the second compressor 218 through line 224, where it is compressed from 2,000 to 3,600 psi suitable for vehicle use. The gas, now at 3,600 psi, is passed through outlet line 226 for storage in the second storage tank 220 for future use by end users.

As will be readily appreciated, the gas compression system 200 of the present invention utilizes a two-stage compression and storage process to ensure that the larger natural gas distribution system is not compromised. In particular, utilizing a small horsepower first compressor 214 (rated at approximately 50 hp), ensures that the supply of gas in line 212 is not fully consumed by the first compressor 214 during this first compression stage. That is, by only bleeding a small amount of gas from the supply line to slowly fill the first storage tank 216 with compressed gas at approximately 2,000 psi, the adverse effects on the larger supply system are minimized. This is in contrast to existing systems that utilize large compressors that consume substantially all of the gas passing through the municipal supply line during operation, leaving little or none for surrounding consumers.

Moreover, by storing the compressed gas at 2,000 psi in the first storage tank 216, the second stage of compression, going from 2,000 psi to 3,600 psi doesn't draw on the supply of gas in line 212. Instead, by drawing upon the stored gas in the first storage tank 216 at the intermediate pressure of 2,000 psi, there isn't much gas being consumed from the supply main 212 in a short period of time (only that to slowly fill the first storage tank 212 when gas exits for second stage compression).

As will be readily appreciated, the compressors 214, 216 cost less to purchase and operate as compared to compressors employed in existing systems due to their lower horsepower rating and thus, lower energy draw. Accordingly, the system 200 of the present invention may realize operational cost savings as a result of lower power consumption. As discussed above, the system 200 of the present invention is also advantageous in that it does not compromise the integrity of the larger supply system. This is accomplished utilizing the two-stage compression and storage process, as described herein. Moreover, the system 200 of the present invention enables the use of tanks manufactured to support pressure levels of 2,000 psi (as opposed to solely 3,600 psi), which are less expensive than tanks designed to handle higher pressures.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. An apparatus or the storage of gaseous fuel, comprising:

an outer tank;

an inner tank housed within said outer tank and spaced radially therefrom, defining an annular space therebetween;

a resin disposed within said annular space; and an electric heating mesh disposed circumferentially in physical contact with the inner tank.

2. The apparatus of claim 1, wherein:

said outer tank includes a generally cylindrical outer body having two ends and generally semi-spherical outer end caps closing off said ends.

3. The apparatus of claim 2, wherein:

said inner tank includes a generally cylindrical inner body having two ends and general semi-spherical inner end caps closing off said ends.

4. The apparatus of claim 3, wherein:

said outer body has an outside diameter of approximately 24 inches and a length of approximately 244 inches; and wherein a thickness of said outer body is approximately 0.375 inches.

5. The apparatus of claim 3, wherein:

said inner body has an inside diameter of approximately 20 inches and a length of approximately 240 inches; and wherein a thickness of said inner body is about 0.5 inches to about 0.675 inches.

6. The apparatus of claim 5, wherein:

said outer end caps have a thickness approximately 0.25 inches greater than said thickness of said outer body; and said inner end caps have a thickness approximately 0.25 inches greater than said thickness of said inner body.

7. The apparatus of claim 3, wherein:

said outer tank and said inner tank are manufactured from ASTM A537 Class 1 Carbon Steel.

8. The apparatus of claim 1, wherein:

said outer tank, said inner tank and said resin define a substantially monolithic tank wall.

9. A double-walled storage tank system for fuel, said storage tank system comprising:

an inner storage tank for storing said fuel;

an electric heating mesh in physical contact with said inner storage tank;

an outer tank encompassing said inner storage tank;

an annular space intermediate said outer tank and said inner storage tank; and, an epoxy resin within said annular space and joining said inner storage tank to said outer tank.

10. The storage tank system of claim 9, wherein:

said outer tank has an outside diameter of approximately 24 inches; and a thickness of said outer body is approximately 0.375 inches.

11. The storage tank system of claim 10, wherein:

said inner tank has an inside diameter of approximately 20 inches; and a thickness of said inner body is about 0.5 inches to about 0.675 inches.

12. An apparatus for the storage of gaseous fuel, comprising:

an outer tank;

an inner tank housed within said outer tank and spaced radially therefrom, defining an annular space therebetween;

a resin disposed within said annular space; and an electric heating mesh disposed circumferentially in physical contact with the inner tank and the resin, the resin in additional physical contact with the inner tank through the electric heating mesh.

* * * * *